United States Patent [19]

Cyr

[11] 4,249,405

[45] Feb. 10, 1981

[54] WIRE OR CABLE BENDING APPARATUS

[76] Inventor: Robert Cyr, 9750 Transit Rd., East Amherst, N.Y. 14051

[21] Appl. No.: 29,197

[22] Filed: Apr. 12, 1979

[51] Int. Cl.[3] ..... B21D 7/024

[52] U.S. Cl. ..... 72/34; 72/217; 72/307

[58] Field of Search ..... 72/32, 33, 34, 217, 72/218, 219, 388, 307

[56] References Cited

U.S. PATENT DOCUMENTS

| | | | |
|---|---|---|---|
| 747,466 | 12/1903 | McClellan | 72/34 |
| 2,371,695 | 3/1945 | Lancaster | 72/32 |
| 2,403,420 | 7/1946 | Willingham | 72/34 |
| 2,934,945 | 5/1960 | Geenen et al. | 72/217 |
| 3,581,537 | 6/1971 | Lance et al. | 72/32 |

*Primary Examiner*—Lowell A. Larson
*Attorney, Agent, or Firm*—Frank P. Cyr

[57] ABSTRACT

A manually operated wire or cable bending apparatus comprising a support assembly for supporting a forming die at one end thereof. A drum assembly comprising a pair of spaced apart interconnected weighted members is mounted on the support assembly, one such weighted member provided with graduations thereon from 0° to 360° on one end face thereof, whereas the other said weighted member having a means for swivelly securing a measuring tape which is adjustably mounted on said support assembly. The forming die comprises a forming block pivotally mounted on a rotatable handle, the forming block cooperating with a fixed grooved forming die to bend a wire or cable positioned between the said forming block and said grooved forming a die when a handle to which the said forming block is pivotally mounted thereon is rotated counterclockwise. A back-up support is rigidly secured to said support assembly and serves to properly align the wire or cable to be bent by the said forming block and grooved forming die. A compass card having graduations thereon from 0° to 180° is frictionally mounted on a shaft to which the aforesaid handle is secured. The shaft extends through the said fixed grooved forming die and a pointer fixedly secured to said support assembly extends to a position in close proximity to said compass card to indicate the degree bend applied to a wire or cable bent with the foregoing apparatus.

3 Claims, 3 Drawing Figures

WIRE OR CABLE BENDING APPARATUS

BACKGROUND OF THE INVENTION

In numerous industries and particularly in the electronics industry where a semi-rigid coaxial cable is employed between terminals, it is desirable that a wire or cable to be used therefor be of a given length and be pre-bent to a given configuration in order to enable the installer of such wire or cable to quickly position the same to the intended supporting surface and to secure the same thereto in any known manner, such as with fasteners or the like. Oftentimes, when a portion of a wire or cable has to be bent to a given degree bend angle to meet with installation requirements, the installer of such wire or cable guesses at the amount of bend angle he should impart to the wire or cable, and as can be appreciated, this can be quite time consuming and with no assurance that the bend angle applied to the wire as well as to exact area where such a bend is to be formed will meet with the installation requirements.

With the above in mind, it is one of the objects of the invention to provide a portble wire or cable bending apparatus whereby wires or cables can be formed of a given length and bent to a predetermined angle and with means associated with said wire and cable bending apparatus whereby bends of varying angles can be accurately and quickly formed by one employing the bending apparatus of the present invention.

Another object of the invention is to enable the user of the bending apparatus of the present invention to refer to a previously prepared programmed schedule which will inform the user thereof of the location along the length of the wire or cable where a bend is to be imparted thereto along with the angle of the bend.

Another object of the invention is to provide a wire or cable bending apparatus with a manually operated handle which has a forming block pivotally mounted thereon which will cooperate with a grooved forming die to effect a bend in the wire or cable when a wire is positioned between the forming block and grooved forming die and the handle is rotated counterclockwise.

Another object of the invention is to provide a visual means whereby the user of the bending apparatus, can, by referring to a pre-programmed schedule, produce a bend in the wire or cable at a predetermined area along the length of the wire or cable.

Other objects and advantages of the invention will become apparent by reference to the following detailed description thereof and the accompanying drawing illustrating a preferred embodiment of the invention.

DESCRIPTION OF THE PREFERRED EMBODIMENTS

Figures 1, 2, 3:
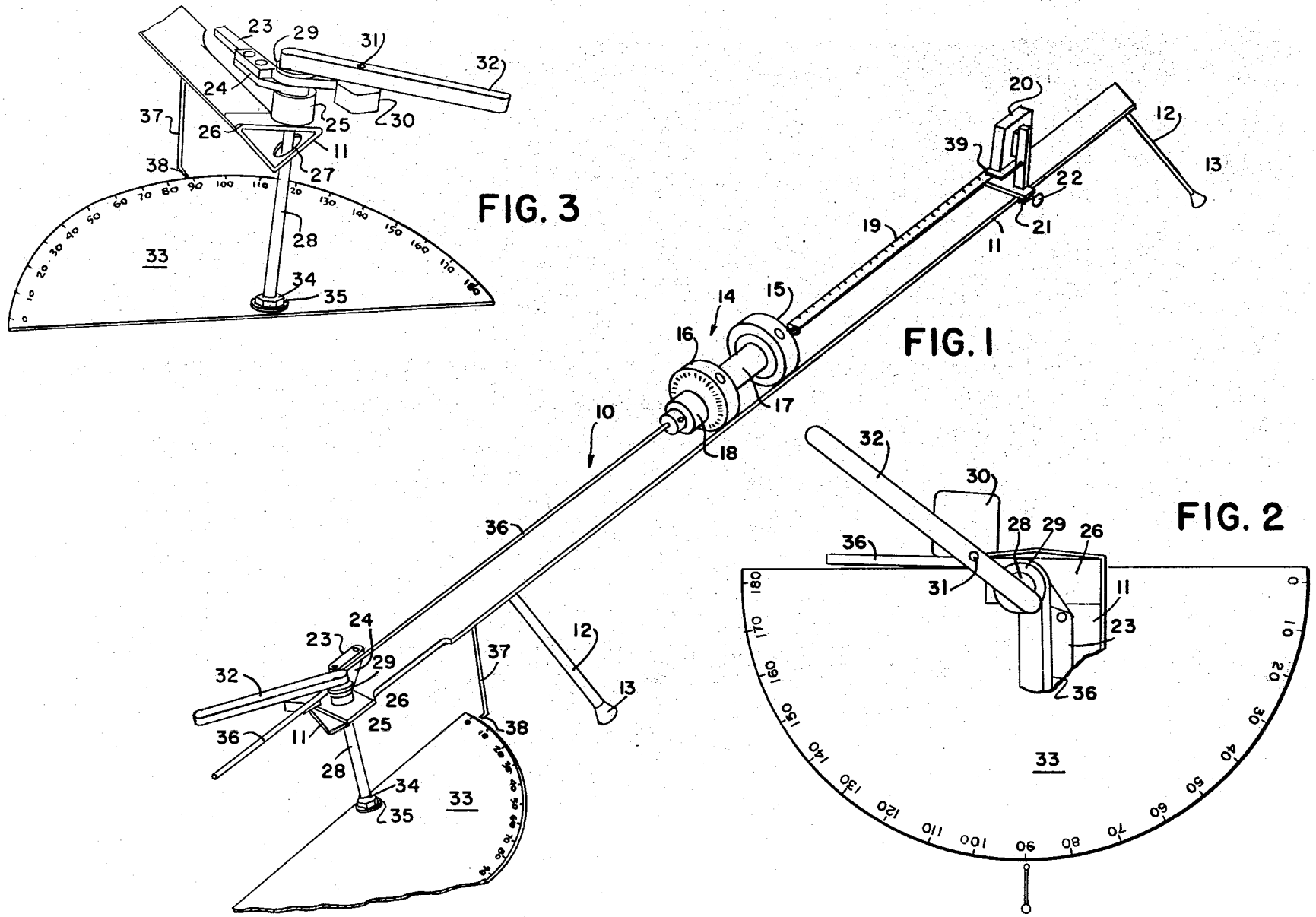
FIG. 1 is a perspecitve view of the wire or cable bending apparatus of the present invention.
FIG. 2 is an enlarged view showing the wire or cable bending elements, with parts broken away, and, FIG. 3 is a front elevation, with parts broken away, showing the bending elements of the present invention.

Before undertaking a detailed description of the apparatus shown in the drawings, it should be pointed out that the apparatus is designed particularly for forming bends in semi-rigid cables, such as coaxial cables of small diameter such as is widely used in the electronics industry. As can be appreciated, the bent wire or cable can also be used in other industries. The structure to be described hereinafter is designed to be used where it is desired to reproduce wires or cables having the required length and also having the bends formed therein at the desired locations along the length of the wire or cable. To enable one to reproduce wires or cables having the required length as well as the bends formed therein at certain designated areas along the length of the wire or cable, a programmed schedule is prepared and therein is given the information such as the bend angle to be imparted to the wire or cable as well as the distance between each bend formed in the wire or cable. Thus, as can be appreciated, one resorting to the information contained in the programmed schedule can reproduce any number of wires or cables of the required length and also having the bent portions thereof at their proper location along the length of the wire or cable.

Referring now to the drawings wherein like reference numerals are employed to designate like parts throughout the several views thereon, reference numeral 10 designates in general, a bending apparatus constructed in accordance with the present invention. Numeral 11 designates a V-shaped support which may be made of metal, plastic, or the like. Legs 12 are secured in any known manner to the undersurface of the V-shaped support and may be provided with rubber caps 13 to provide a non-slip engagement of the legs with a supporting surface such as a table, work bench, or the like (not shown).

Supported for sliding movement within the aforesaid V-shaped support is a drum assembly shown generally at 14. Drum assembly 14 comprises a pair of circularly shaped weighted members 15, 16, fixedly mounted to a shaft 17 extending therebetween. Graduations from 0° to 360° are provided along one face of the weighted member 16 for a purpose to be explained more fully hereinafter. Mounted on the weighted member 16 is a conventional chuck 18 which is used to engage with one end of the wire or cable to be bent. The chuck may be one which is key operated in order to insure a firm gripping of the wire or cable by the chuck. Swivelly secured to the weighted member 15 is a measuring tape 19 of conventional construction which is caused to be extended from and spring retracted within the tape housing 20 when the drum assembly is slid along in the said V-shaped support. The tape housing 20 is provided with a suitable bracket 21 and thumbscrew 22, or the like, whereby the tape housing may be clamped to the V-shaped support. The bracket 21 is also provided with a pointer 39 located in close proximity to the measuring tape for an accurate measurement reference point.

Mounted at the forward end of the said V-shaped support is a back-up support 23 which is secured to a flange 24 which is formed integral with or otherwise secured to a fixed bushing 25 which is welded or otherwise secured to a cross member 26 which extends between and is secured to the sides of the V-shaped support. Extending through the bushing 25 and through an opening 27 formed in one side of the aforesaid V-shaped support is a shaft 28. Fixedly mounted on fixed bushing 25 is a grooved forming die 29 which may be made from metal, plastic or like material. A forming block 30 of plastic or like material is pivoted as at 31 to the undersurface of a manually operated handle 32. It will be noted that the forming block is mounted off center on the handle and has markings 1 and 2 thereon for a purpose to be explained more fully hereinafter.

A bend angle compass card is frictionally secured to the lower end of the shaft 28 and is secured thereto by means of an upper nut 34 and nylon washer 35. A like lower nut and nylon washer (not shown) engages the shaft 28 and cooperate with the upper nut and washer to frictionally secure the compass card to the shaft 28. The compass card 33 is provided with graduations thereon starting with 0° to 180°. The wire or cable to be bent to the predetermined bend angle as shown on a programmed schedule is shown at 36 and as disclosed in FIG. 1 of the drawings, one end thereof is mounted in the chuck 18 whereas the opposite end thereof is shown extending beyond the grooved forming die 29.

A bend angle pointer 37 is secured in any known manner to the undersurface of the V-shaped support member and a portion thereof shown at 38 extends in the same plane with the compass card 33.

As stated previously, the user of the bending apparatus refers to a programmed schedule which has been previously prepared and the schedule will inform the user of the bend angle to be imparted to the wire or cable. Also, the schedule will set forth the distance along the length of the wire or cable where such bends should occur, and by sliding the drum assembly in the V-shaped support, the tape which is secured thereto will indicate the distance required between the portions to be bent. Also, if following the formation of a bend in the wire or cable it is then necessary to form another bend along the length of the wire or cable but being in a different plane with respect to the previously formed bend, the user of the apparatus will rotate the drum assembly in the V-shaped support until such time as the graduations formed on the face of weighted member 16 is in alignment with one of the side edges of the V-shaped support. For instance, if a second bend in the cable is to be at right angles to the plane of the previously formed bend and to be spaced therefrom, the drum assembly is rotated in the V-shaped support until such time as the graduation 90° on the face of the weighted member is in alignment with one of the sides of the V-shaped support and since the cable is caused to rotate along with the drum assembly the following bend imparted to the cable will be at right angles to the previously formed bend. If the second bend is to be spaced 6 inches from the previously formed bend, the drum assembly is slid in the V-shaped support until such time as the measuring tape shows a 6 inch spacing from the previously formed bend and with the free end of the cable extending through the forming die, rotation of the handle to the desired degree angle as indicated on the compass card will result in the formation of the required bend at the desired location along the length of the cable.

As stated previously, the forming block 30 is pivotally mounted as at 31 to the handle 32 and as shown in the drawings, the block 30 is mounted off-center to the aforesaid handle. For the normal bending operation, the position No. 1 indicated is employed which places the block farthest away from the wire or cable 36. However, in instances where bends which are to be formed in the wire or cable are in close proximity to one another, the block is rotated so as to be in the No. 2 position with the block being closer to the cable 36.

After inserting a given length of cable into the chuck 18 which is part of the drum assembly 17, the other cable end is positioned in the grooved bending die and aligned with an alignment mark on the grooved bending die. The measuring tape bracket 21 is then moved on the V groove and set such that the measuring tape indicates zero and is secured to the support by thumbscrew 22.

It must be remembered that at the start of a bending operation to impart bends in a wire or cable, the compass card 33 must be rotated to a position where 0° is in alignment with the pointer 27. Then, by referring to the programmed schedule, one may easily reproduce the formation of bends in a wire or cable.

It is to be understood that the above described arrangements are simply illustrative of the application of the principles of this invention. Numerous other arrangements may be readily devised by those skilled in the art which will embody the principles of the invention and fall within the spirit and scope thereof.

What is claimed is:

1. A manually operated wire or cable bending apparatus comprising a V-shaped support for supporting a pair of weighted members within said V-shaped support, one of said weighted members having a chuck mounted thereon for securing a wire or cable thereto and the other of said weighted members having an adjustable measuring tape swivelly secured thereto, a fixed bushing mounted on said V-shaped support, a grooved bending die fixedly mounted on said V-shaped support a rotatable handle having a shaft secured thereto with said shaft extending through said bending die and said bushing and terminating below said support, a forming block mounted off-center at one end of said handle, a wire or cable extending between said grooved die and said forming block, a compass card with graduations thereon frictionally secured to the lower end of said shaft, said forming block and said fixed grooved bending die adapted to impart a bend in the wire or cable when said handle is rotated counter-clockwise with respect to the said support.

2. The structure recited in claim 1 wherein said compass card has graduations thereon from 0° to 180°.

3. The structure recited in claim 1 wherein a bend angle pointer is secured to the undersurface of the said support and extends to a position in close proximity to the said compass card.

* * * * *